US009504332B2

(12) United States Patent
Gladney

(10) Patent No.: US 9,504,332 B2
(45) Date of Patent: Nov. 29, 2016

(54) HYBRID MATTRESS ASSEMBLIES

(71) Applicant: DREAMWELL, LTD., Las Vegas, NV (US)

(72) Inventor: Richard F. Gladney, Fairburn, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 139 days.

(21) Appl. No.: 14/078,837

(22) Filed: Nov. 13, 2013

(65) Prior Publication Data

US 2014/0165292 A1 Jun. 19, 2014

Related U.S. Application Data

(60) Provisional application No. 61/737,537, filed on Dec. 14, 2012, provisional application No. 61/750,511, filed on Jan. 9, 2013.

(51) Int. Cl.

| | |
|---|---|
| ***A47C 23/04*** | (2006.01) |
| ***A47C 27/05*** | (2006.01) |
| ***A47C 27/06*** | (2006.01) |

(52) U.S. Cl.

CPC ..... *A47C 27/05* (2013.01); *A47C 27/053* (2013.01); *A47C 27/056* (2013.01); *A47C 27/064* (2013.01)

(58) Field of Classification Search

CPC .. A47C 27/15; A47C 27/148; A47C 27/144; A47C 27/20; A47C 27/056; A47C 27/05; A47C 23/002; A47C 31/123; A47C 27/04; A47C 27/053; A47C 27/14; A47C 27/06

USPC ..... 5/690, 716, 717, 718, 719, 720, 721, 5/727, 728, 740

See application file for complete search history.

(56) References Cited

U.S. PATENT DOCUMENTS

| | | | | |
|---|---|---|---|---|
| 7,047,581 | B2 | 5/2006 | Gladney | |
| 7,168,117 | B2 | 1/2007 | Gladney et al. | |
| 7,251,847 | B2 * | 8/2007 | Wells | 5/716 |
| 7,690,096 | B1 | 4/2010 | Gladney et al. | |
| 8,099,811 | B2 | 1/2012 | Gladney et al. | |
| 8,353,072 | B2 * | 1/2013 | Klancnik | 5/698 |
| 2004/0237204 | A1 * | 12/2004 | Antinori | 5/716 |
| 2005/0005354 | A1 * | 1/2005 | Gladney et al. | 5/256 |
| 2006/0096032 | A1 * | 5/2006 | Rensink | 5/721 |
| 2007/0204407 | A1 | 9/2007 | Lee | |
| 2007/0283501 | A1 * | 12/2007 | Mossbeck | A47C 27/00 5/727 |

(Continued)

FOREIGN PATENT DOCUMENTS

| | | |
|---|---|---|
| CN | 201664103 U | 10/2008 |
| CN | 201790376 U | 11/2013 |
| GB | 2274054 A | 7/1994 |

OTHER PUBLICATIONS

International Search Report & Written Opinion, issued in International Application No. PCT/US2013/070056, dated Jan. 8, 2014; 12 pages.

(Continued)

*Primary Examiner* — David E Sosnowski

(74) *Attorney, Agent, or Firm* — Cantor Colburn LLP

(57) ABSTRACT

Mattress assemblies that provide increased user comfort and increased airflow. The mattress assemblies generally include a multilayered mattress core including at least one coil spring layer disposed on and in direct contact with a viscoelastic foam layer.

21 Claims, 2 Drawing Sheets

(56) References Cited

U.S. PATENT DOCUMENTS

| | | | | |
|---|---|---|---|---|
| 2008/0092302 | A1* | 4/2008 | Rensink | 5/690 |
| 2008/0288273 | A1* | 11/2008 | Rawls-Meehan | 705/1 |
| 2010/0072676 | A1 | 3/2010 | Gladney et al. | |
| 2010/0115703 | A1* | 5/2010 | Kluft | 5/717 |
| 2010/0115704 | A1* | 5/2010 | Rensink | 5/721 |
| 2010/0223733 | A1* | 9/2010 | Ahn et al. | 5/721 |
| 2011/0047708 | A1 | 3/2011 | Rensink et al. | |
| 2012/0180224 | A1* | 7/2012 | DeMoss et al. | 5/717 |
| 2012/0246833 | A1* | 10/2012 | Kluft et al. | 5/717 |
| 2012/0272457 | A1* | 11/2012 | Allman et al. | 5/716 |
| 2012/0315460 | A1 | 12/2012 | LaFlamme | |
| 2013/0025069 | A1* | 1/2013 | Ruehlmann et al. | 5/740 |
| 2013/0174350 | A1* | 7/2013 | Allman et al. | 5/740 |
| 2013/0263380 | A1* | 10/2013 | Young et al. | 5/719 |
| 2013/0269115 | A1* | 10/2013 | Bader | 5/718 |
| 2015/0067967 | A1* | 3/2015 | Tyree | 5/691 |

OTHER PUBLICATIONS

Notification Concerning Transmittal of International Preliminary Report on Patentability (Chapter I of the Patent Cooperation Treaty), issued in International Patent Application No. PCT/US2013/070056, dated Jun. 25, 2015; 8 pages.

Office Action and English Translation of Office Action, issued in Chinese Application No. 201380065284.6, dated Jul. 5, 2016; 15 pages.

Office Action issued in European Application No. 13799158.4-1653, dated Jun. 15, 2016; 3 pages.

* cited by examiner

HYBRID MATTRESS ASSEMBLIES

CROSS REFERENCE TO RELATED APPLICATIONS

The present application claims the benefit of U.S. Provisional Application No. 61/737,537 filed on Dec. 14 2012, and U.S. Provisional Application No. 61/750,511 filed on Jan. 9, 2013, incorporated herein by reference in their entireties.

BACKGROUND

The present disclosure generally relates to mattress assemblies, and more particularly, to hybrid mattress assemblies including at least one coil spring layer disposed on viscoelastic foam support layer.

Mattresses such as those formed of polyurethane foam, latex foam, and the like, with or without coiled springs, are generally known in the art. One of the ongoing problems associated with mattress assemblies is user comfort. To address user comfort, these mattresses are often fabricated with multiple foam layers having varying properties such as density and hardness, among others, to suit the needs of the intended user. More recently, manufacturers have employed so called memory foams, also commonly referred to as viscoelastic foams, which are typically a combination of polyurethane and one or more additives that increase foam density and viscosity, thereby increasing its viscoelasticity. These foams are often open cell foam structures having both closed and open cells but in some instances may be reticulated foam structures. When used in a mattress, the memory foam conforms to the shape of a user when the user exerts pressure onto the foam, thereby minimizing pressure points from the user's body. The memory foam then returns to its original shape when the user and associated pressure are removed. However, the return to the original shape is a relatively slow process because of the viscoelastic cellular structure of these types of foams.

Unfortunately, the high density of foams used in current mattress assemblies, particularly those employing memory foam layers, generally prevents proper ventilation. As a result, the foam material can exhibit an uncomfortable level of heat to the user after a period of time. Additionally, these foams can retain a high level of moisture, further causing discomfort to the user and potentially leading to foul odors.

Accordingly, it would be desirable to provide a mattress assembly, especially a mattress including one or more layers of viscoelastic memory foam, with an improved airflow to effectively dissipate user heat. Still further, it would be desirable to provide foam mattress assemblies with increased user comfort.

BRIEF SUMMARY

Disclosed herein are mattress assemblies and mattress cores exhibiting increased airflow and user comfort. In one embodiment, an elongated mattress core for a mattress structure comprises at least one coiled spring layer; and an underlying support layer comprising a viscoelastic foam, wherein the coiled spring layer is in direct contact with the viscoelastic foam.

A mattress assembly comprises a mattress core comprising at least one coiled spring layer, and an underlying support layer comprising a viscoelastic foam, wherein the coiled spring layer is in direct contact with the viscoelastic foam; and a side rail assembly circumscribing a perimeter of the mattress core, the side rail assembly comprising a layer of a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, wherein the layer is configured to be disposed about a perimeter of an inner core of the mattress and is configured to permit the flow of fluid from and to the mattress core through the layer.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are mattress cores and mattress assemblies including the mattress cores that provide improved user comfort as well as improved airflow to effectively dissipate user heat during use, among other advantages. The mattress assemblies include a combination of foam layers and at least one coil spring layer, wherein the at least one coil spring layer is disposed directly on an underlying viscoelastic foam layer. Additional foam layers of any type can be provided to overlay and/or underlay the combination of the coil spring layer and the underlying viscoelastic foam layer. The mattress assemblies may be a mattress of any size, including standard sizes such as a twin, queen, oversized queen, king, or California king sized mattress, as well as custom or non-standard sizes constructed to accommodate a particular user or a particular room. Moreover, the mattress assemblies can be configured as one sided or two sided mattresses depending on the configuration and the desired application.

Figure 1:
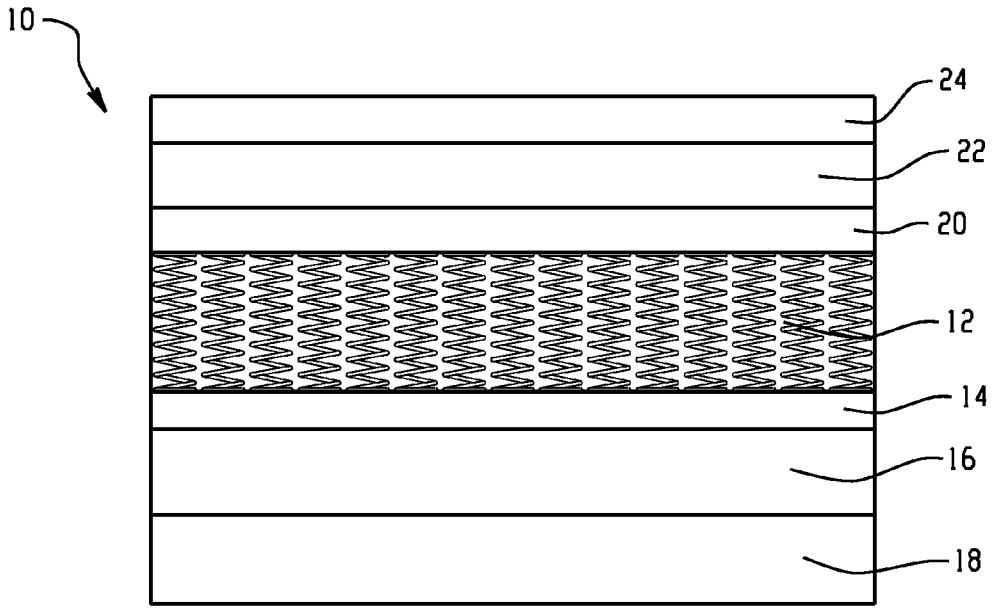
FIG. 1 illustrates a cross sectional view of a mattress core in accordance with an embodiment of the present disclosure.

Turning now to FIG. 1, there is depicted a mattress core 10 for use in a mattress assembly including a plurality of layers. The mattress core 10 has at least one coil spring layer 12 disposed on a viscoelastic foam layer 14. One or more additional foam layers 16, 18, 20, 22, and 24 of any type may be included as may be desired to attain a desired mattress thickness. Although five additional layers are depicted, more or less foam layers can be employed. Moreover, the thicknesses of the various foam layers including the viscoelastic foam layer 14 can vary and are generally from about ½ inch in thickness to about 12 inches in thickness. In one Applicant have discovered that by providing at least one coil layer on an underlying viscoelastic layer, improved user comfort results. Moreover, by use of a coil spring layer in the foam mattress core, improved temperature management results since airflow into and out of the core is increased relative to an all-foam mattress.

Viscoelastic polyurethane foam has an open-cell structure that reacts to body heat and weight by molding to the sleeper's body, helping relieve pressure points, preventing pressure sores, and the like. Most viscoelastic polyurethane foams have the same basic chemical composition; however the density and layer thickness of the foam makes different mattresses feel very different. A high-density mattress will have better compression ratings over the life of the bedding. A lower-density one will generally have slightly shorter life due to the compression that takes place after repeated use. Cell structures can vary from very open to almost closed cell. The tighter the cell structure, the less airflow through the foam. Breathable viscoelastic foam will have a more open cell structure, allowing higher airflow, better recovery, and lower odor retention at packaging.

The coil springs are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

The proposed coil spring construction for use in the mattress assembly can employ a stranded wire spring which is made of at least 2 wire strands that are twisted to form a multi-wire cord. The number of strands employed will vary according to the application and may vary based on the type of material used to form the strand. Thus, the wire may include two or more strands, and can include from three to fifty strands.

The strands may be twisted, weaved, clipped or bonded together and any suitable method for forming the stranded wire spring may be employed without departing from the scope of the invention. The strands may be steel, aluminum, plastic, copper, titanium, rubber or any other suitable material and the type of material selected will depend upon the application at hand. Moreover, the strands may have any suitable shape and may be long cylindrical wires, hexagonal wire, square wire or any other shape or geometry. Additionally, the wire strand gauge may vary according to the application and in one embodiment comprises 710 gauge wire, although other gauges may be used.

In one practice, coiling may be achieved construction by passing a braided strand through a coiler, such as the type of coiler employed for forming steel mattress coils wherein a heavy-gauge steel wire is compressed into a barrel-shaped coil such that no turns touch for eliminating noise and vibration. The coils may then be passed to a pocketing machine or station to pocket the springs into individual sleeves of a non-woven, non-allergenic fabric such as Duon. Each sleeve may be ultrasonically sealed, a process where the fibers are melted together to form solid plastic seams that are secure and tear-resistant. The coils are then fusion bonded to produce a strong, stable construction. The number of coils in each unit may vary, and the types of coils and the number of strands and gauge of strands can vary from pocket to pocket.

The individual strands are connected with each other at least at the ends of the coil. Since the strands can rub against each other over the length of the coil, which can cause fretting and premature wear, the strands may be coated and/or pre-galvanized. Moreover, the stranded coil may also be sealed with a sealant, such as an epoxy. Thus, in alternative and optional embodiments, the strands may be coated or otherwise treated and the wire may be sealed or coated. Exemplary stranded wire for use in mattresses is disclosed in U.S. Pat. No. 7,047,581, U.S. Pat. No. 7,168,117, and U.S. Pat. No. 8,099,811 incorporated herein by reference in its entireties.

The coil springs may optionally be encased, i.e., pocketed, in an envelope or an open coil and arranged in rows. The construction of the coil spring layer may be a plurality of rows of parallel coils with the coils aligned in columns so that the coils line up in both longitudinal and lateral directions or they may be nested in a honeycomb configuration wherein coils in one row are offset from coils in an adjacent row as is generally known in the art. Adjacent spring coils may be connected with adhesive. Alternatively, adjacent spring coils may be connected with a hog ring or other metal fasteners. In yet other embodiments, adjacent spring coils are not connected along the upper portion of the coils. As is generally known in the art, the coils can be of any diameter; be symmetrical or asymmetrical, be designed with linear or non-linear behavior, or the like as may be desired for the different intended applications. In one embodiment, the length of the coils range from 1 to 10 inches; and 2 to 6 inches in other embodiments.

Suitable other foam layers include, without limitation, synthetic and natural latex, polyurethane, polyethylene, polypropylene, and the like. Optionally, in some embodiments, one or more of the foam layers may be pre-stressed such as is disclosed in U.S. Pat. Pub. No. 2010/0072676, incorporated herein by reference in its entirety.

Other layers may include any materials suitable for a mattress, such as batting, foam, waterproof liners, and so forth. In certain assemblies using coils, the one or more additional layers may include a relatively firm bottom panel layer that distributes the upward force of each spring top to provide a more uniform feel to the sleeping surface. In this embodiment, the combination of the coil spring layer disposed in direct contact on the viscoelastic foam layer will overlay the bottom panel layer.

The mattress assemblies, and any variations thereof, may be manufactured using techniques known in the art of mattress making, with variations to achieve the mattress described above. Likewise, the various mattress layers in the mattress assemblies described above may be adjoined to one another using an adhesive or may be thermally bonded to one another or may be mechanically fastened to one using another hog rings, staples, and/or other techniques known in the art.

By way of example, a mattress core having an overall thickness of 11 inches includes, in sequence from bottom to top, a 2 inch layer of pre-stressed polyurethane (P85), a 1 inch pre-stressed latex layer (L-30), a ½ inch viscoelastic foam layer having a density of 2.5 lb/ft$^3$, 3.5 inch stranded pocketed coil spring, 2 inches of pre-stressed polyurethane foam layer (P11); a 1 inch viscoelastic foam layer having a density of 4.5 polyurethane foam layer lb/ft$^3$, and a 1 inch microgel infused phase change material foam layer having a convoluted surface with the tips facing downwards. The microgel infused phase change material layer overlies the foam layers, and in some embodiments, will overly a side rail assembly that circumscribes a perimeter of the various layers seated on the polyurethane base layer.

In a mattress core having an overall thickness of 12 inches, the core is disposed on a 2 inch layer of pre-stressed polyurethane (P85) and includes a 2 inch pre-stressed polyurethane foam layer (P85), a ½ inch thick viscoelastic foam layer having a density of 4.5 lb/ft$^3$, a 3.5 inch coil spring, a 1 inch of thick viscoelastic foam layer having a density of 4.5 lb/ft$^3$, a 1 inch pre-stressed polyurethane foam layer (P85), and a 2 inch microgel infused phase change material layer having a convoluted surface with the tips facing downwards. The microgel infused phase change material layer overlies the foam layers, and in some embodiments, will overly a side rail assembly that circumscribes a perimeter of the various layers seated on the polyurethane base layer.

In a mattress core having an overall thickness of 13 inches, the core is disposed on a 3 inch layer of pre-stressed polyurethane (P85) and includes a 1.5 inch pre-stressed latex foam layer (L-30), a 1 inch thick viscoelastic foam layer having a density of 4.5 lb/ft$^3$, a 3.5 inch coil spring, a 2 inch of thick viscoelastic foam layer having a density of 4.5 lb/ft$^3$, and a 2 inch microgel infused phase change material layer having a convoluted surface with the tips facing downwards. The microgel infused phase change material layer overlies the foam layers and the 8 inch thick foam rails that are circumscribing the perimeter of the various layers seated on the polyurethane base layer.

In a mattress core having an overall thickness of 14 inches, the core is disposed on a 4 inch layer of pre-stressed polyurethane foam layer (P85) and includes a 2 inch viscoelastic foam layer having a density of 5.5 lb/ft$^3$, a 3.5 inch coil spring layer, ½ inch of a latex foam layer having a ILD of 14, ½ inch of viscoelastic foam layer having a density of 5.5 lb/ft$^3$, a 1.5 inch pre-stressed polyurethane foam layer (P85), and a 4 inch microgel infused phase change material layer having a convoluted surface with the tips facing downwards. The microgel infused phase change material layer overlies the foam layers, and in some embodiments, will overly a side rail assembly that circumscribes a perimeter of the various layers seated on the polyurethane base layer.

In these embodiments, the various multiply stacked layers may be adjoined to one another using an adhesive or may be thermally bonded to one another or may be mechanically fastened to one another.

As noted above, the combination of the foam layers and the at least one coil spring layer in the various mattress core embodiments can be encased with a high airflow side rail system to define the respective mattress assembly. By encasement, it is meant that the side rail assemblies can be disposed about a perimeter of the mattress inner core and provide support to a peripheral edge of a mattress. At least a portion of the side rail assembly, in some embodiments the entire assembly, in other embodiments one or more layers, is comprised of the high airflow foam, which is described in detail below.

Figure 2:
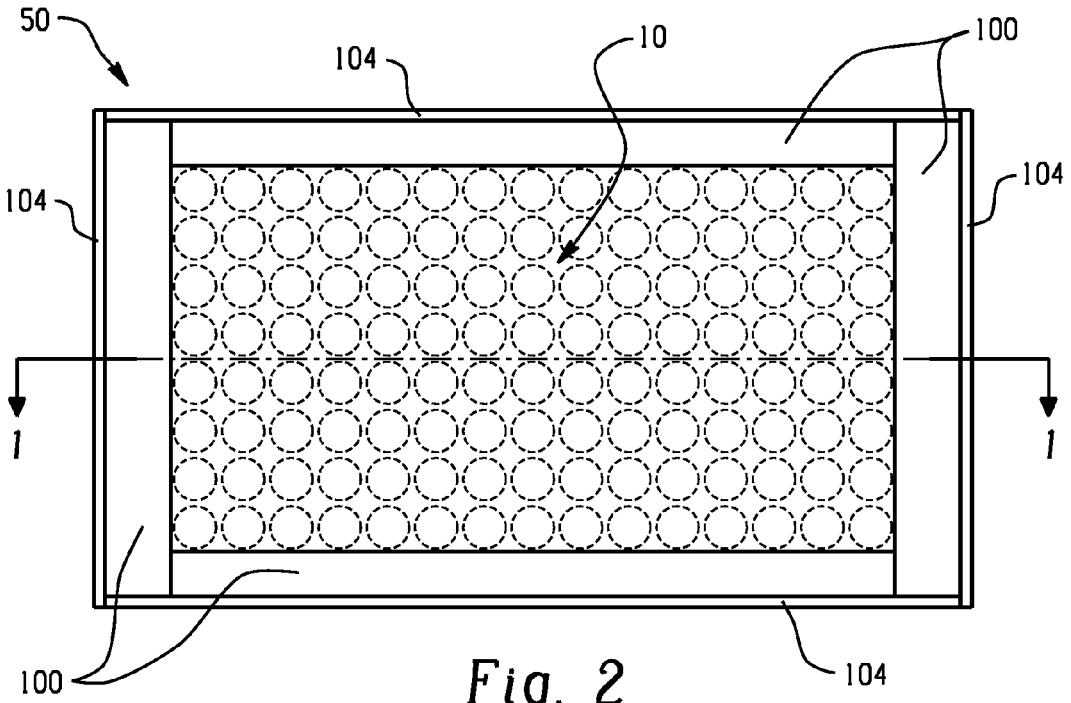
FIG. 2 illustrates a top down view of a mattress assembly in accordance with an embodiment of the present disclosure.
Figure 3:
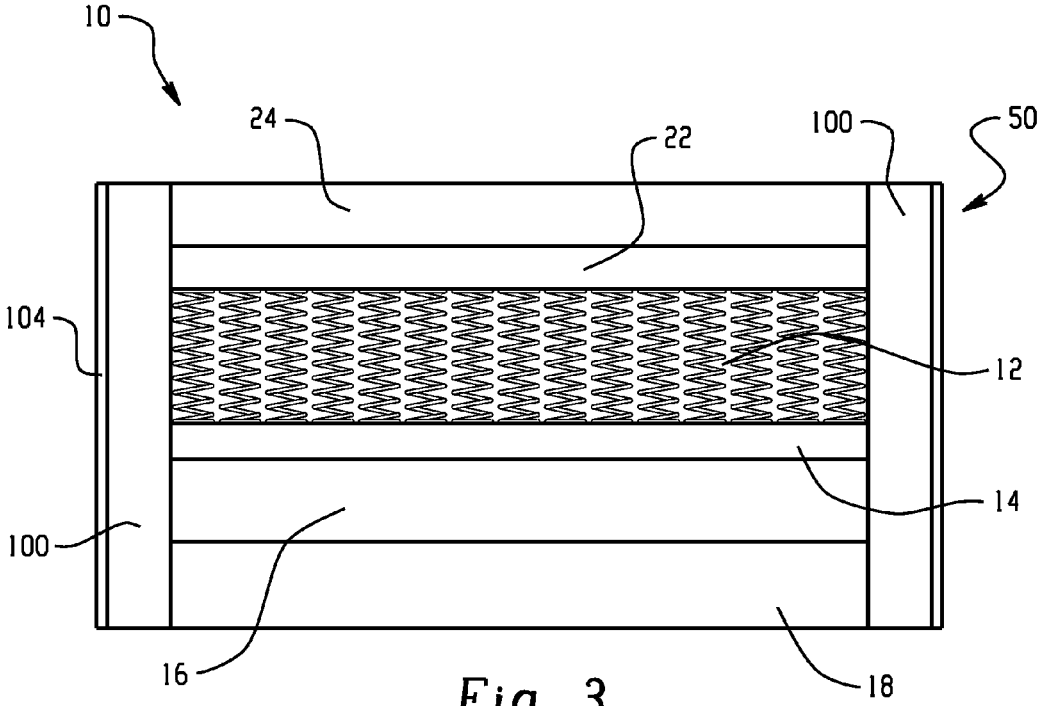
FIG. 3 illustrates a cross sectional view of a mattress assembly taken along line 1-1 of FIG. 2 in accordance with an embodiment of the present disclosure.

Turning now to FIGS. 2-3 a top down view representative of an exemplary mattress assembly 50 including a mattress core 10 and a high airflow side rail assembly 100 is illustrated. As will be discussed herein, the various embodiments of the mattress assemblies have in common the following components: multiple stacked layers including at least one coil spring layer disposed on a viscoelastic layer that defines the mattress core 10 wherein the uppermost foam layer 24 of the mattress core is shown, a side rail assembly 100 about at least a portion of the perimeter of the stacked mattress layers, and an optional fabric covering 104 about the side rail assembly 100 as shown, i.e., mattress border. The uppermost layer 24 is generally referred to herein as the cover layer and has a planar top surface adapted to substantially face the user resting on the mattress assembly and having a length and width dimensions sufficient to support a reclining body of the user. As described above, in one embodiment, the upper most layer 24 is a microgel infused phase change material layer having a convoluted surface with the tips facing downwards.

FIG. 3 shows a cross sectional view of a mattress assembly taken along lines 1-1 of FIG. 2. The mattress assembly 50 includes a base core foam layer 18 configured with generally planar top and bottom surfaces. For this as well as the other embodiments disclosed herein, the base core foam layer 18 is chosen to have a thickness greater than or equal to the overall thickness of the mattress assembly. Generally, the thickness of the base core foam layer 18 is 1 inch to 6 inches, and a thickness of about 1 inch to 4 inches thickness in other embodiments. The base core foam layer 18 can be formed of standard polyurethane foam although other foams can be used, including without limitation, viscoelastic foams. In one embodiment, the base core foam layer is an open cell polyurethane foam and is pre-stressed. Suitable pre-stressed polyurethane foams are generally formed in the manner disclosed in U.S. Pat. No. 7,690,096 to Gladney et al., incorporated herein by reference in its entirety. By way of example, a force can be applied to at least a section of a standard polyurethane foam layer in an amount sufficient to temporarily compress its height so as to permanently alter a mechanical property of the foam layer to provide a pre-stressed foam layer having a firmness that is different from the firmness of a similar polyurethane foam that was not pre-stressed. The pre-stressed foam layer can be a standard polyurethane foam as noted above (i.e., not viscoelastic) and generally has a pre-stressed thickness of less than 6 inches.

The mattress assembly further includes a foam side rail assembly 100 about all or a portion of the perimeter of the mattress layers e.g., 12, 14, 16, 18, 20, 22, and 24. The side rails that define the assembly may be attached or placed adjacent to at least a portion of the perimeter of the mattress layers. Side rails may be placed on opposing sides of the stacked mattress layers, on all four sides of the stacked mattress layers, or only on one side of the stacked mattress layers. In certain embodiments, the side rails may comprise edge supports with a firmness greater than that provided by the stacked mattress layers. The side rails may be fastened to the stacked mattress layers via adhesives, thermal bonding, or mechanical fasteners.

In one embodiment, the side rail assembly 100 is formed of open cell polyurethane foam having a non-random large cell structure or a random cellular structure with many large cells. The open cell foam structure includes a plurality of interconnected cells, wherein the windows between the adjacent cells are broken and/or removed. In contrast, a closed cell foam has substantially no interconnected cells and the windows between the adjacent cells are substantially intact. In reticulated foams, substantially all of the windows are removed. The polyurethane foam of the side rail assembly 100 has an open cell structure, wherein the percentage of intact windows (i.e., cell walls) between adjacent cells is less than about 50 percent; specifically less than about 40 percent; more specifically less than about 30 percent; and still more specifically less than about 20 percent. The large cell structure can also be defined by the number of cells per linear inch. In one embodiment, the large cell structure is about 10 to 40 cells per inch, with about 15 to 30 cells per inch in other embodiments, and with about 20 cells per inch in still other embodiments. The hardness of the foam side rail, also referred to as the indention load deflection (ILD) or indention force deflection (IFD), is within a range of about 35 to about 100 pounds-force, wherein the hardness is measured in accordance with ASTM D-3574. In one embodiment, the hardness is about 45 to about 90 pounds-force; and specifically about 50 to about 75 pounds-force. The high air flow foam of the side rail assembly further includes a density of about 1.0 to about 3.0 pounds per cubic foot; and specifically about 1.2 to about 2.0 pounds per cubic foot.

By using an open cell structure with a large cellular or a random cell structure, high airflow foam is created wherein movement of moisture and air through one or more of the side rails in the assembly 100 can occur. Also, if the side rail is adhesively or thermally attached to the mattress core layers, it will be the skeletal struts of the open cell foam that bond to the mattress core layers and the voids of the cell structure can remain free of adhesive agent. Air and moisture transfer is thereby facilitated from the mattress layers through the high air flow foam of the side rails to the environment. In one embodiment, the side rail assembly 100 includes reticulated viscoelastic polyurethane foam.

For ease in manufacturing the mattress assembly, the side rail assembly may be assembled in linear sections as is generally shown in FIG. 2 that are joined to one another to form the perimeter about the mattress core layers. The ends may be square as shown in the top down view FIG. 2 or may be mitered (not shown). Each section of the side rail assembly 100 can include a single layer of high air flow foam. In other embodiments, the side rail assembly can have one or more layers. In still other embodiments, the side rail assembly can have the same number of layers as the mattress or the assembly can have a different amount of layers. In one embodiment, each layer of the side rail assembly is aligned with a corresponding layer of the mattress. Exemplary embodiments of multilayered side rail assemblies will be described in more detail below.

The optional fabric layer 104 is disposed about the perimeter of the side rail, i.e., serves as a mattress border. The fabric border layer is attached at one end to the top planar surface of the uppermost mattress layer e.g., 24 and at the other end to the bottom planar surface of the bottom most layer, e.g., 18. In one embodiment, at least a portion of the fabric layer is formed of a spacer fabric to provide a further increase in airflow. As used herein, spacer fabrics are generally defined as pile fabrics that have not been cut including at least two layers of fabric knitted independently that are interconnected by a separate spacer yarn. The spacer fabrics generally provide increased breathability relative to other fabrics, crush resistance, and a three dimensional appearance. The at least two fabric layers may be the same or different, i.e., the same or different density, mesh, materials, and like depending on the intended application. When employing the spacer fabric, a lightweight flame retardant barrier layer may be disposed intermediate to the mattress foam layers and the spacer fabric about the perimeter of the side rail assembly.

In other embodiments, a side rail assembly 200 includes a base rail layer 202 disposed in physical communication with and adjacent to the bottommost core foam layer, e.g., 18. A top rail layer 204 is disposed above the base rail layer 202. The top rail layer 204 can be formed of high airflow open-cell foam having a non-random large cell structure or a random cellular structure with many large cells. As described above, the high airflow foam of the top rail layer 204 can have an open cell structure, wherein the percentage of intact windows (i.e., cell walls) between adjacent cells is less than about 50 percent; specifically less than about 40 percent; more specifically less than about 30 percent; and still more specifically less than about 20 percent. In one embodiment, the large cell structure is about 10 to 40 cells per inch, with about 15 to 30 cells per inch in other embodiments, and with about 20 cells per inch in still other embodiments.

The top rail layer 204 is aligned with the core layers of the mattress including the at least one coil spring layer. Because top rail layer 204 is formed of high airflow foams and the at least one coil spring layer includes a relatively large amount of free space compared to foams in general, the top rail layer 204 of the side rail assembly 205 acts as a direct vent through the side rail assembly 200 to permit the flow of air and moisture from the mattress core layers through the top rail layer and out of the mattress.

The side rails of the assembly may be fastened to the stacked mattress layers via adhesives, thermal bonding, or mechanical fasteners. Again, if the rails are adhesively or thermally attached to the mattress core layers, e.g., 14, 16, 18, 20, 22, 24, the skeletal struts of the open cell foam in the top rail layer 204 will bond to at least one of the mattress core layers and the voids of the cell structure can remain free of adhesive agent. As such, air and moisture transfer is uninterrupted by the thermal bonding process or adhesive and airflow from the mattress layers through the side rails to the environment is maintained.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An elongated mattress core for a one sided mattress structure, the mattress core comprising:

an upper most layer comprising a microgel infused phase change material comprising a planar surface and a convoluted surface, wherein the convoluted surface faces downwards toward the at least one coiled spring layer;

at least one coiled spring layer;

an underlying support layer comprising a viscoelastic foam consisting of planar top and bottom surfaces free of channels therein and a sidewall extending from the bottom surface to the top surface, wherein the sidewalls define a thickness of the underlying support layer ranging from ½ inch to 2 inches, wherein the coiled spring layer is in direct contact with the viscoelastic foam; and a base core foam layer comprising a non-viscoelastic polyurethane foam, wherein the underlying support layer comprising the viscoelastic foam overlays the base core foam layer.

2. The mattress core of claim 1, wherein the coiled spring layer is of a multi-strand configuration.

3. The mattress core of claim 1, further comprising a second viscoelastic foam layer disposed on and in direct contact the coiled spring layer.

4. The mattress core of claim 1, further comprising at least one additional foam layer.

5. The mattress core of claim 4, wherein the at least one additional layer comprises a latex foam layer.

6. The mattress core of claim 4, wherein the at least one additional layer comprises a pre-stressed foam layer having a firmness that is different from the firmness of the same foam that was not pre-stressed.

7. The mattress core of claim 4, wherein the at least one additional layer comprises a polyurethane foam layer.

8. The mattress core of claim 1, wherein the at least one coiled spring layer comprises a plurality of pocketed coil springs.

9. The mattress core of claim 1, wherein the coiled spring layer comprises open coils.

10. The mattress assembly of claim 1, wherein the at least one coiled spring layer of the mattress core comprises a plurality of pocketed coil springs.

11. The mattress assembly of claim 1, wherein the at least one coiled spring layer comprises 3.5 inch coils.

12. A one sided mattress assembly comprising:

a mattress core comprising an uppermost layer comprising a microgel infused phase change material comprising a planar surface and a convoluted surface, wherein the convoluted surface faces downwards toward the at least one coiled spring layer; at least one coiled spring layer, an underlying support layer comprising a viscoelastic foam consisting of planar top and bottom surfaces free of channels therein and a sidewall extending from the bottom surface to the top surface, wherein the sidewalls define a thickness of the underlying support layer ranging from ½ inch to 2 inches, wherein a bottom surface of the coiled spring layer is in direct contact with the viscoelastic foam, and a base core foam layer comprising a non-viscoelastic polyurethane foam, wherein the underlying support layer comprising the viscoelastic foam overlays the base core foam layer; and a side rail assembly circumscribing a perimeter of the mattress core, the side rail assembly comprising a layer of a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot, wherein the layer is configured to be disposed about a perimeter of an inner core of the mattress and is configured to permit the flow of fluid from and to the mattress core through the layer.

13. The mattress assembly of claim 12, wherein the viscoelastic foam is a viscoelastic polyurethane foam.

14. The mattress assembly of claim 12, wherein the mattress core further comprises one or more additional layers.

15. The mattress assembly of claim 14, wherein the one or more additional layers comprise non-viscoelastic foam, visco elastic foam, pre-stressed foam, gel-infused foam, spring coils, polyurethane foam, encased spring coils, latex, or a combination thereof.

16. The mattress assembly of claim 12, wherein the open cellular structure of the polyurethane foam layer in the side rail assembly comprises a percentage of intact windows between adjacent cells that is less than about 50 percent.

17. The mattress assembly of claim 12, wherein the side rail assembly comprises multiple layers.

18. The mattress assembly of claim 12, wherein the coiled spring layer is of a multi-strand configuration.

19. The mattress assembly of claim 12, wherein the mattress core further comprises a second viscoelastic foam layer disposed on and in direct contact the coiled spring layer.

20. The mattress assembly of claim 12, wherein the coiled spring layer comprises open coils.

21. An elongated mattress core for a one sided mattress structure, the mattress core comprising:

at least one coiled spring layer;

an underlying support layer comprising a viscoelastic foam consisting of planar top and bottom surfaces free of channels therein and a sidewall extending from the bottom surface to the top surface, wherein the sidewalls define a thickness of the underlying support layer ranging from ½ inch to 2 inches, wherein the coiled spring layer is in direct contact with the viscoelastic foam; and a base core foam layer comprising a non-viscoelastic polyurethane foam, wherein the underlying support layer comprising the viscoelastic foam overlays the base core foam layer.

* * * * *